US007406419B2

(12) United States Patent
Malfait

(10) Patent No.: US 7,406,419 B2
(45) Date of Patent: Jul. 29, 2008

(54) QUALITY ASSESSMENT TOOL

(75) Inventor: Ludovic Malfait, Ipswich (GB)

(73) Assignee: Psytechnics Limited, Ipswich (GB)

( * ) Notice: Subject to any disclaimer, the term of this patent is extended or adjusted under 35 U.S.C. 154(b) by 761 days.

(21) Appl. No.: 10/862,840

(22) Filed: Jun. 7, 2004

(65) Prior Publication Data

US 2005/0143977 A1 Jun. 30, 2005

(30) Foreign Application Priority Data

Nov. 7, 2003 (GB) ..... 0326043.7

(51) Int. Cl.
*G10L 21/00* (2006.01)

(52) U.S. Cl. ..... 704/270; 704/207; 704/205

(58) Field of Classification Search ..... 704/203, 704/205, 207, 209, 220, 270; 455/67.11
See application file for complete search history.

(56) References Cited

U.S. PATENT DOCUMENTS 6,330,428 B1 * 12/2001 Lewis et al. ..... 455/67.11

2003/0115515 A1 6/2003 Curtis et al.

FOREIGN PATENT DOCUMENTS

WO 01/35393 A1 5/2001

* cited by examiner

*Primary Examiner*—Huyen X. Vo
(74) *Attorney, Agent, or Firm*—Burr & Brown

(57) ABSTRACT

This invention relates to a new parameter suitable for use in non-intrusive speech quality assessment system. The invention provides a method of generating a parameter from a signal comprising a sequence of values measured from voiced portions of said signal at a sampling frequency, said parameter suitable for use in a quality assessment tool. The method includes steps of selecting portions of frequency transformed sections of the signal in dependence upon a pitch estimate; generating an average value for each portion; and generating a section parameter depending upon the difference between the averages of successive portions. Said section parameter is averaged over a number of iterations of the method to generate the new parameter of the invention.

6 Claims, 6 Drawing Sheets

Fig 4a - Signal
value
time
512 values
Fig. 4b - Pitch marks
80 values
81 values
P-1 P P+1
Fig 4c - Fast Fourier Transform
value
frequency
H0
H1
H2
H3
H4
H5
A B C D E F G
100 200 300 400 500 600

QUALITY ASSESSMENT TOOL

BACKGROUND OF THE INVENTION

This application claims the benefit of United Kingdom Patent Application No. 0326043.7, filed Nov. 7, 2003, the entirety of which is incorporated herein by reference.

This invention relates to a new parameter suitable for use in non-intrusive speech quality assessment system.

Signals carried over telecommunications links can undergo considerable transformations, such as digitisation, encryption and modulation. They can also be distorted due to the effects of lossy compression and transmission errors.

Objective processes for the purpose of measuring the quality of a signal are currently under development and are of application in equipment development, equipment testing, and evaluation of system performance.

Some automated systems require a known (reference) signal to be played through a distorting system (the communications network or other system under test) to derive a degraded signal, which is compared with an undistorted version of the reference signal. Such systems are known as "intrusive" quality assessment systems, because whilst the test is carried out the channel under test cannot, in general, carry live traffic.

Conversely, non-intrusive quality assessment systems are systems which can be used whilst live traffic is carried by the channel, without the need for test calls.

Non-intrusive testing is required because for some testing it is not possible to make test calls. This could be because the call termination points are geographically diverse or unknown. It could also be that the cost of capacity is particularly high on the route under test. Whereas, a non-intrusive monitoring application can run all the time on the live calls to give a meaningful measurement of performance.

A known non-intrusive quality assessment system uses a database of distorted samples which has been assessed by panels of human listeners to provide a Mean Opinion Score (MOS).

MOSs are generated by subjective tests which aim to find the average user's perception of a system's speech quality by asking a panel of listeners a directed question and providing a limited response choice. For example, to determine listening quality users are asked to rate "the quality of the speech" on a five-point scale from Bad to Excellent. The MOS, is calculated for a particular condition by averaging the ratings of all listeners.

In order to train the quality assessment system each sample is parameterised and a combination of the parameters is determined which provides the best prediction of the MOSs indicted by the human listeners. International Patent Application number WO 01/35393 describes one method for paramterising speech samples for use in a non-intrusive quality assessment system.

This invention relates to improved parameters for a speech quality assessment system.

According to the invention there is provided a method of generating a parameter from a signal comprising a sequence of values measured from voiced portions of said signal at a sampling frequency, said parameter suitable for use in a quality assessment tool, said method comprising the steps of a) selecting a section of said signal;

b) performing a frequency transform on said section to provide a sequence of frequency values;

c) generating a pitch frequency estimate;

d) selecting a plurality of portions of said sequence of frequency values in dependence upon said pitch frequency estimate, said portions having a frequency range and a central frequency;

e) generating an average value for each of said plurality of portions;

f) generating a section parameter in dependence upon the difference between the average value for one portion of said sequence of frequency values and the average value for a subsequent portion of said sequence of frequency values;

g) repeating steps a)-f) to provide a plurality of said section parameters and generating said parameter by generating an average in dependence upon said plurality of said section parameters.

Said section of said sequence of values may be selected such that a pitch mark is associated with a value central to said section.

The frequency transform may comprise a Fast Fourier Transform.

The step of generating a pitch frequency estimate may comprise the steps of using pitch marks associated with said sequence of values; comparing the number of values between a value associated with a pitch mark and a value associated with an immediately preceding pitch mark with the number of values between the value associated with the pitch mark and a value associated with an immediately following pitch mark; and generating said pitch frequency estimate in dependence upon the minimum number of said values, and the sampling frequency.

The portions of said sequence of frequency values may be selected by generating multiples of said pitch frequency estimate, said multiples representing harmonics of said pitch frequency estimate; and selecting portions in which the frequency range of the portion is substantially equal to half said pitch frequency estimate; and which the central frequency of each portion is either a frequency substantially equal to one of said multiples, or a frequency substantially half way between two of said multiples.

The invention also provides a method of training a quality assessment tool comprising the step of training a mapping for use in a method of assessing speech quality in a telecommunications network, such that a fit between a quality measure generated from a plurality of parameters for a signal and the mean opinion score associated with said signal is optimised by said mapping wherein said plurality of parameters includes a parameter generated according to any on of the preceding claims.

The invention also provides a method of assessing speech quality in a telecommunications network comprising the steps of generating a parameter according to any one of the preceding claims; generating a quality measure in dependence upon said parameter.

Embodiments of the invention will now be described, by way of example only, with reference to the accompanying drawings, in which:

DETAILED DESCRIPTION OF THE EMBODIMENT

Figure 1:
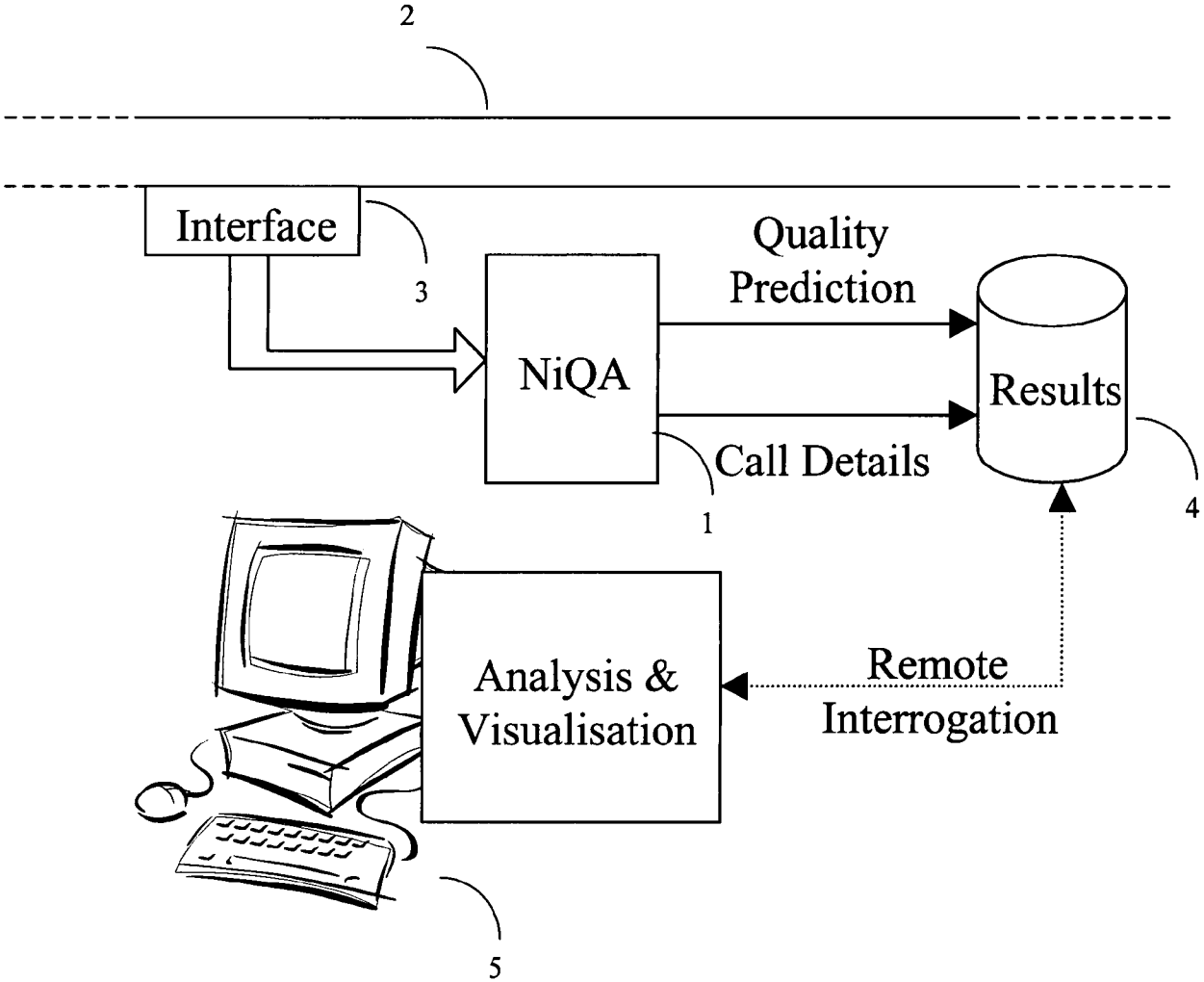
FIG. 1 is a schematic illustration of a non-intrusive quality assessment system.

Referring to FIG. 1, a non-intrusive quality assessment system 1 is connected to a communications channel 2 via an interface 3. The interface 3 provides any data conversion required between the monitored data and the quality assessment system 1. A data signal is analysed by the quality assessment system, and the resulting quality prediction is stored in a database 4. Details relating to data signals which have been analysed are also stored for later reference. Further data signals are analysed and the quality prediction is updated so that over a period of time the quality prediction relates to a plurality of analysed data signals.

The database 4 may store quality prediction results from a plurality of different intercept points. The database 4 may be remotely interrogated by a user via a user terminal 5, which provides analysis and visualisation of quality prediction results stored in the database 4.

Figure 2:
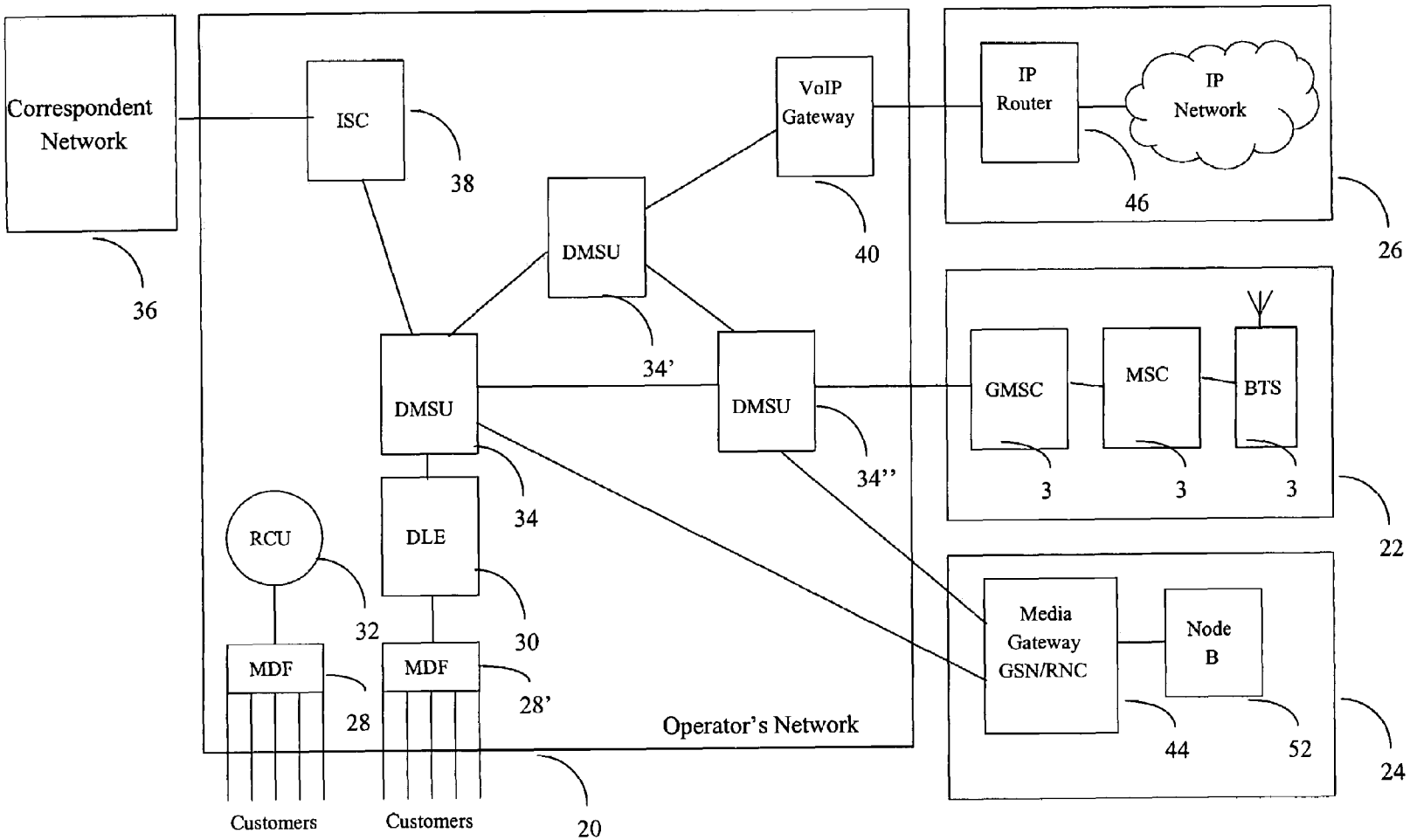
FIG. 2 is a schematic illustration showing possible non-intrusive monitoring points in a network.

FIG. 2 is a block diagram of an illustrative telecommunications network showing possible intercept points where non-intrusive quality assessment may be employed.

The telecommunication network shown in FIG. 2 comprises an operator's network 20 which is connected to a Global System for Mobile communications (GSM) mobile network 22, a third generation (3G) mobile network 24, and an Internet Protocol (IP) network 26. The operator's network 20 is accessed by customers via main distribution frames 28, 28' which are connected to a digital local exchange (DLE) 30 possibly via a remote concentrator unit (RCU) 32. Calls are routed through digital multiplexing switching units (DMSU) 34, 34,', 34" and may be routed to a correspondent network 36 via an international switching centre (ISC) 38, to the IP network 26 via a voice over IP gateway 40, to the GSM network 22 via a Gateway Mobile Switching Centre (GMSC) 42 or to the 3G network 24 via a gateway 44. The IP network 26 comprises a plurality of IP routers of which one IP router 46 is shown. The GSM network 22 comprises a plurality of mobile switching centres (MSCs), of which one MSC 48 is shown, which are connected to a plurality of base transceiver stations (BTSs), of which one BTS 50 is shown. The 3G network 24 comprises a plurality of nodes, of which one node 52 is shown.

Non intrusive quality assessment may be performed, for example, at the following points:

At the DLE 30 incoming calls to specific customer, output from an exchange may be assessed.

At the DMSUs 34, 34', 34", links between DMSUs and interconnects with other operators may be assessed.

At the ISC 38 the international link may be assessed.

At the Voice over IP gateway 40 the interface with an IP network may be assessed.

At the MSC 48 calls to and from the mobile network may be assessed.

At the IP router 46 calls to and from the IP network may be assessed.

At the media gateway 44 calls to and from the 3G network may be assessed.

A variety of testing regimes and configurations can be used to suit a particular application, providing quality measures for selections of calls based upon the user's requirements. These could include different testing schedules and route selections. With multiple assessment points in a network, it is possible to make comparisons of results between assessment points. This allows the performance of specific links or network subsystems to be monitored. Reductions in the quality perceived by customers can then be attributed to specific circumstances or faults.

The data, stored in the database 4, can be used for a number of applications such as:

Network Health Checks
Network Optimisation
Equipment Trials/Commissioning
Realtime Routing
Interoperability Agreement Monitoring
Network Trouble Shooting
Alarm Generation on Routes
Mobile Radio Planning/optimisation Referring now to FIG. 3, a method of training a non-intrusive quality assessment system according to the present invention will now be described. It will be understood that this method may be carried out by software controlling a general purpose computer.

A database 60 contains distorted speech samples containing a diverse range of conditions and technologies. These have been assessed by panels of human listeners to provide a MOS, in a known manner. Each speech sample therefore has an associated MOS derived from subjective tests. The database 60 includes speech signal having the following network conditions and impairments amongst others, mobile network errors, mutes, low bit rate speech codecs, noise, transcoding, Voice over Internet Protocol (VoIP), Digital Circuit Multiplication Equipment (DCME) clipping.

At 61 each sample is pre-processed to normalise the signal level and take account of any filtering effects of the network via which the speech sample was collected. The speech sample is filtered, level aligned and any DC offset is removed. The amount of amplification or attenuation applied is stored for later use.

At step 62 tone detection is performed for each sample to determine whether the sample is speech, data, or if it contains DTMF or musical tones. If it is determined that the sample is not speech then the sample is discarded, and is not used for training the quality assessment tool.

At step 63 each speech sample is annotated to indicate periods of speech activity and silence/noise. This is achieved by use of a Voice Activity Detector (VAD) together with a voiced/unvoiced speech discriminator.

At step 64 each speech sample is annotated to indicate positions of the pitch cycles using a temporal/spectral pitch extraction method. This allows parameters to be extracted on a pitch synchronous basis, which helps to provide parameters which are independent of the particular talker. Vocal Tract Descriptors are extracted as part of the speech parameterisation described later and need to be taken from the voiced sections of the speech file. A final pitch cycle identifier is used to provide boundaries for this extraction. A characterisation of the properties of the pitch structure over time is also passed to step 65 to form part of the speech parameters.

The parameterisation step 65 is designed to reduce the amount of data to be processed whilst preserving the information relevant to the distortions present in the speech sample.

In this embodiment of the invention over 300 candidate parameters are calculated including the following:

Noise Level
Signal to Noise Ratio
Average Pitch of Talker
Pitch Variation Descriptors Length Variations Frame to Frame content variations Instantaneous Level Fluctuations Vocal Tract Descriptors:

In addition to the above, various descriptions of the vocal tract parameters are calculated. They capture the overall fit of the vocal tract model, instantaneous improbable variations and illegal sequences. Average values and statistics for individual vocal tract model elements over time are also included as base parameters. For example, see International Patent Application Number WO 01/35393.

Distortion identification may also be performed. This is not described here, as it is not relevant to the present invention. A full description may be found in co-pending European Patent Application number 03250333.6.

The inventors have recently invented a new spectral clarity parameter which significantly improves performance of the speech quality assessment method.

The generation of this parameter from the portions of the signal which have been marked as voiced at step 63 will now be described, with reference to FIGS. 4*a*-4*c* and FIG. 5.

Figure 4:
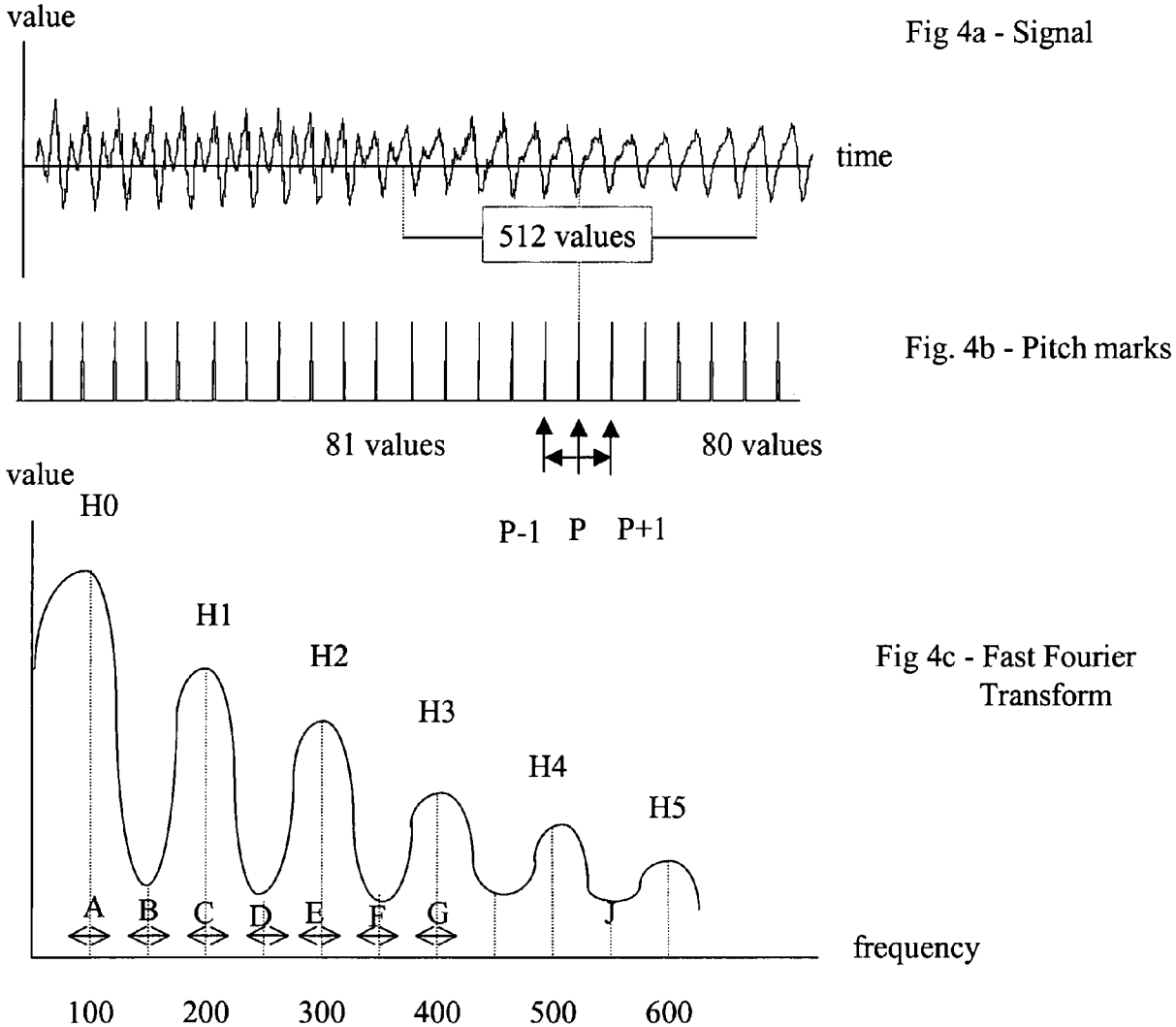
FIG. 4*a* to 4*c* illustrate signal processing in order to generate a parameter in accordance with the present invention.
Figure 5:
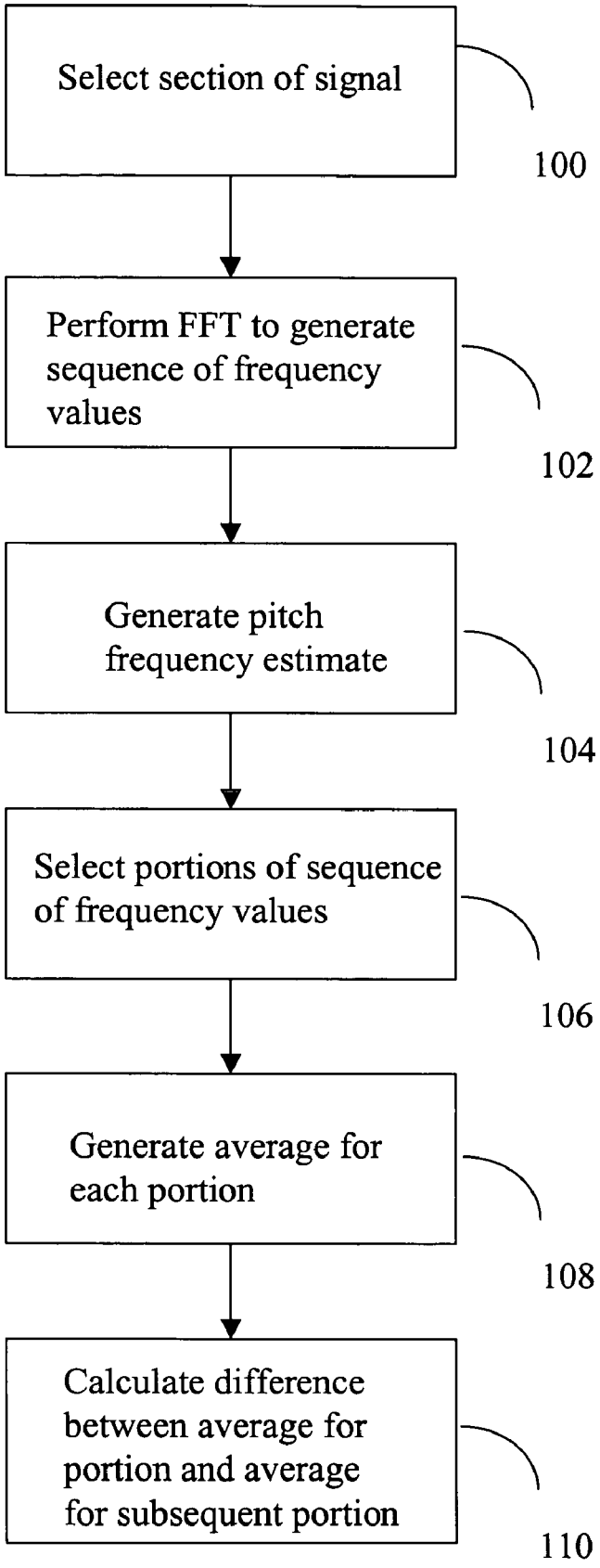
FIG. 5 is a flow chart illustrating generation of a parameter in accordance with the present invention.

At step 100 a section of a signal such as that shown in FIG. 4*a* is selected. The signal comprises a sequence of values which have been measured at a particular sampling frequency. In this embodiment of the invention the signal is sampled at a frequency of 8000 Hz. FIG. 4*b* represents a sequence of pitch marks previously extracted and associated with the signal. A section comprising 512 values is selected such that a value associated with a pitch mark P is central to the selected section. A Blackman Harris window is then applied to the portion and a Fast Fourier Transform is applied at step 102 to produce a sequence of frequency values as illustrated schematically in FIG. 4*c*. It will be understood that other frequency transforms for example a Discrete Fourier Transform (DFT) could equally well be used.

The logarithm of each frequency value is calculated in order to provide a value which is independent of the level (average) of the original signal. At step 104, a pitch frequency estimate is generated as follows. The number of values between pitch mark P and pitch mark P+1 is compared to the number of values between pitch mark P and pitch mark P−1. In this example the differences are 80 and 81 values respectively. The minimum is selected, and the pitch frequency estimate is calculated in dependence upon the sampling frequency. Therefore in this example the pitch frequency estimate is 100 Hz. The pitch frequency estimate represents the pitch of the speech and is represented by H0.

At step 106 portions of the sequence of frequency values are selected in dependence upon the pitch frequency estimate as follows. Harmonics (H1-H5) are estimated to occur around multiples of the pitch frequency estimate H0, so in this example we would expect H1 to be around 200 Hz, H2 to be around 300 Hz etc. These are illustrated schematically in FIG. 4*c*. It would be possible to calculate a more precise harmonic frequency by performing 'peak picking' around the expected frequency value of the harmonics.

Portions comprising a frequency range of half the pitch frequency estimate are selected, although other shorter frequency ranges could be used. The centre frequency of the portions selected are equal to either a frequency value of a harmonic, or to a frequency value half way between two harmonics. Selected portions A, B, C, D, E, F, G are illustrated in FIG. 4*c*. Note that if the frequency range of a portion equal to half the frequency range of the pitch frequency estimate is used then there will be no space between subsequent selected portions.

An average value for each portion is then calculated at step 108, simply by summing the sequence of values in each portion and dividing the total by the number of values in said portion.

Then finally at step 110 the sum of differences between two adjacent portions is calculated and an average over the number of peaks used is generated. In this embodiment of the invention the differences used to generate the parameter are those associated with the portions relating to H2 to H5 and the subsequence portion in each case. This is because H1 is in generally filtered out in practice because of the telephone bandwidth.

A parameter is thus generated for each pitch mark, and in order to generate a parameter for the whole of the voiced part of the signal a simple average is generated.

Once all of the parameters have been calculated, including the new parameter described above, mapping 76, is trained at 68. Once the optimum mapping between the parameters for each speech sample and the MOS associated with each speech sample (provided by the database 60) has been determined a characterisation of the mapping is saved at step 69, which includes identification of the particular parameters which resulted in the optimum mapping.

In this embodiment the mapping is a linear mapping between the chosen parameters and MOSs and the optimum mapping is determined using linear regression analysis, such that once the mapping has been trained at step 68, the mapping 76 is characterised by a set of parameters used together with a weight for each parameter.

Figure 6:
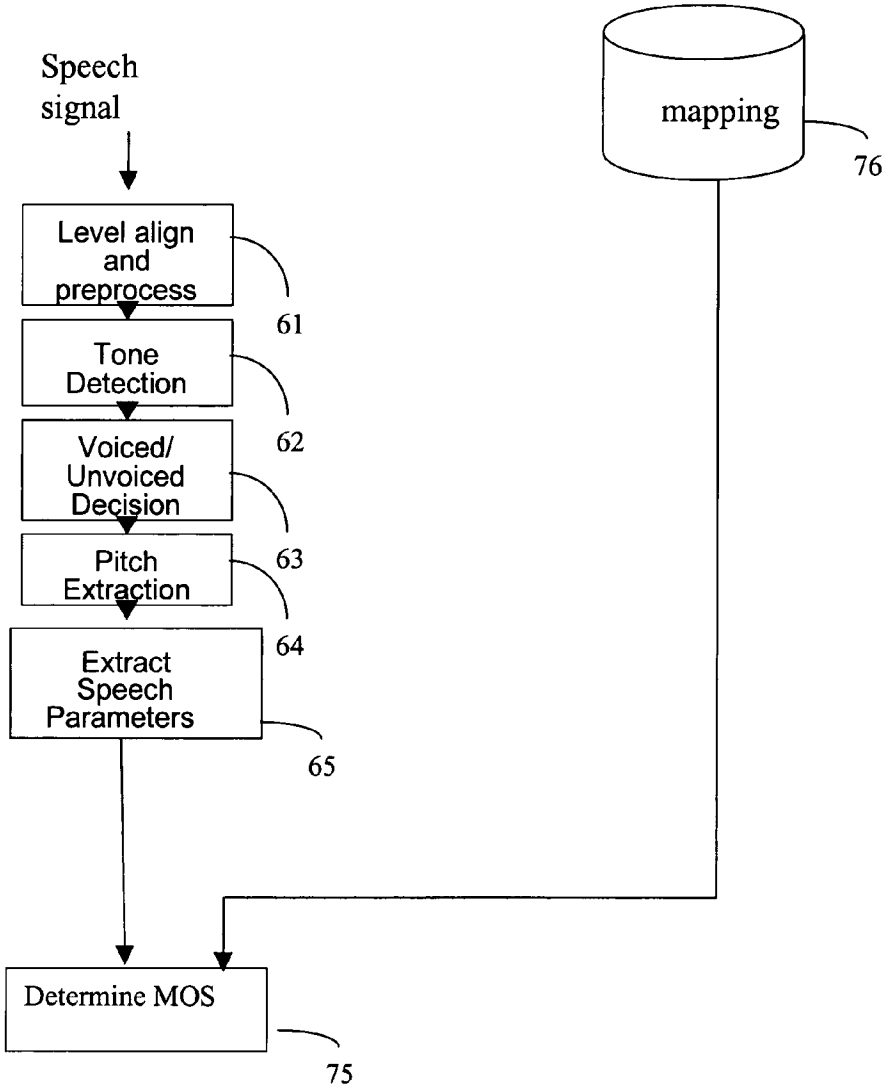
FIG. 6 is a flow chart illustrating the operation of an assessment tool of the present invention.

The operation of the non-intrusive quality assessment tool, once training has been completed, will now be described with reference to FIG. 6.

Figure 3:
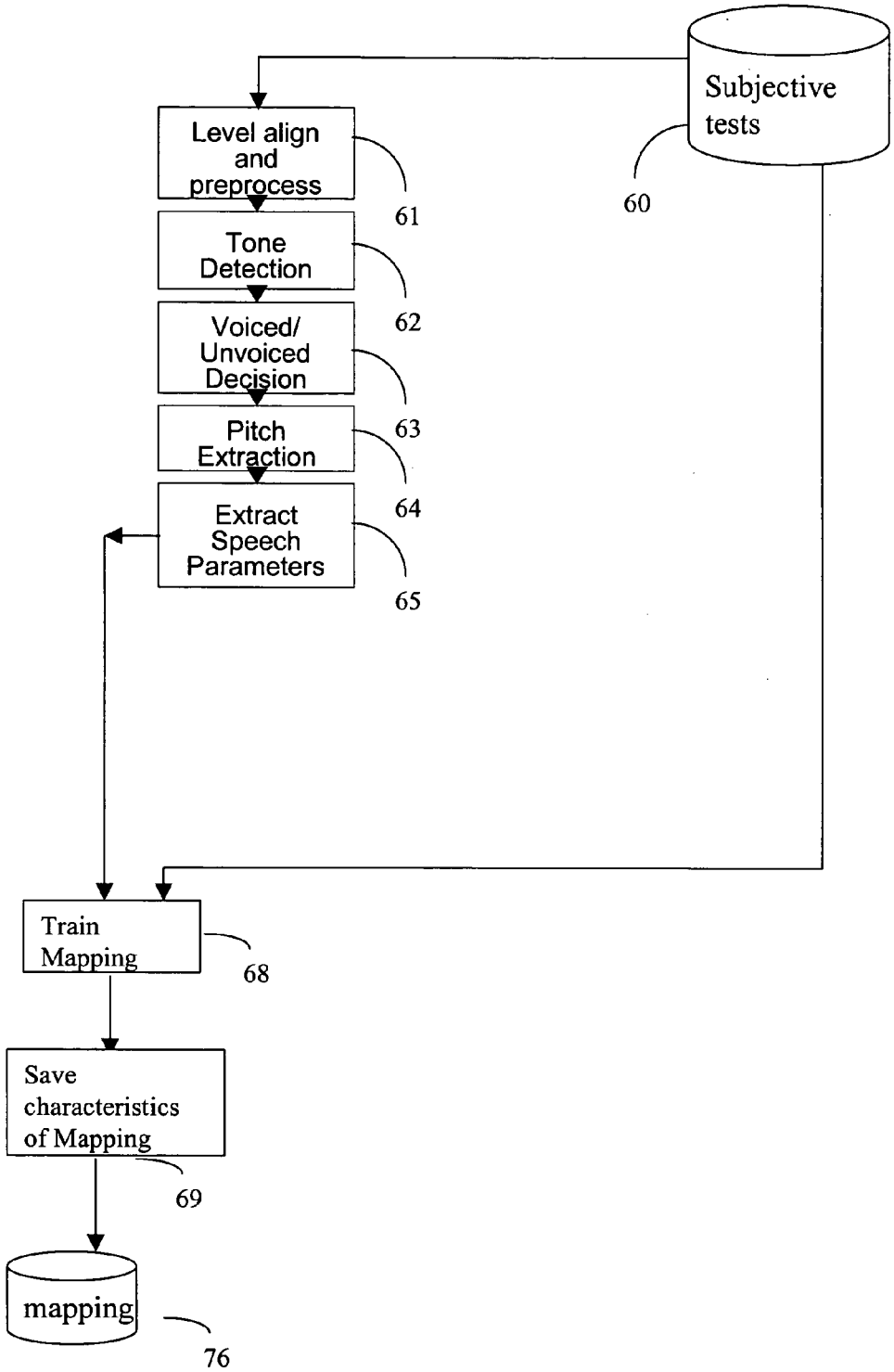
FIG. 3 is a flow chart illustrating training a quality assessment tool according to the present invention.

The steps for operation of the quality assessment tool are similar to the steps shown in FIG. 3, which are performed during training of the overall mapping for the quality assessment tool.

Steps 61-64 operate as described with reference to FIG. 3. In this case only one sample is processed at a time. At step 75 the previously saved mapping characteristics 76 are used to determine a MOS for the sample.

It will be understood by those skilled in the art that the methods described above may be implemented on a conventional programmable computer, and that a computer program encoding instructions for controlling the programmable computer to perform the above methods may be provided on a computer readable medium.

It will be appreciated that whilst the process above has been described with specific reference to speech signals, the processes are equally applicable to other types of signals, for example video signals.

The invention claimed is:

1. A method of assessing speech quality in a telecommunications network comprising the steps of:

generating a parameter from a signal comprising a sequence of values measured from voiced portions of said signal at a sampling frequency, said parameter suitable for use in a quality assessment tool, said method comprising the sub-steps of:

a) selecting a section of said signal;

b) performing a frequency transform on said section to provide a sequence of frequency values;

c) generating a pitch frequency estimate;

d) selecting a plurality of portions of said sequence of frequency values in dependence upon said pitch frequency estimate, said portions having a frequency range and a central frequency;

e) generating an average value for each of said plurality of portions;

f) generating a section parameter in dependence upon the difference between the average value for one portion of said sequence of frequency values and the average value for a subsequent portion of said sequence of frequency values;

g) repeating steps a)-f) to provide a plurality of said section parameters and generating said parameter by generating an average in dependence upon said plurality of said section parameters;

generating a quality measure in dependence upon said parameter; and storing said quality measure on a computer readable medium accessible by a user for visualization and analysis.

2. A method according to claim 1, in which said section of said sequence of values is selected such that a pitch mark is associated with a value central to said section.

3. A method according to claim 1, in which said frequency transform comprises a Fast Fourier Transform.

4. A method according to claim 1, in which the step of generating a pitch frequency estimate comprises the steps of using pitch marks associated with said sequence of values; comparing the number of values between a value associated with a pitch mark and a value associated with an immediately preceding pitch mark with the number of values between the value associated with the pitch mark and a value associated with an immediately following pitch mark; generating said pitch frequency estimate in dependence upon the minimum number of said values, and the sampling frequency.

5. A method according to claim 1, in which said portions of said sequence of frequency values are selected by generating multiples of said pitch frequency estimate, said multiples representing harmonics of said pitch frequency estimate; and selecting portions in which the frequency range of the portion is substantially equal to half said pitch frequency estimate; and which the central frequency of each portion is either a frequency substantially equal to one of said multiples, or a frequency substantially halfway between two of said multiples.

6. A method of training a quality assessment tool comprising the steps of:

training a mapping for use in a method of assessing speech quality in a telecommunications network, such that a fit between a quality measure generated from a plurality of parameters for a signal and the mean opinion score associated with said signal is optimised by said mapping wherein said plurality of parameters includes a parameter generated by a method comprising the sub-steps of:

a) selecting a section of said signal;

b) performing a frequency transform on said section to provide a sequence of frequency values;

c) generating a pitch frequency estimate;

d) a plurality of portions of said sequence of frequency values in dependence upon said pitch frequency estimate, said portions having a frequency range and a central frequency;

e) generating an average value for each of said plurality of portions;

f) generating a section parameter in dependence upon the difference between the value for one portion of said sequence of frequency values and the average value for a subsequent portion of said sequence of frequency values;

g) repeating steps a)-f) to provide a plurality said section parameters and generating said parameter by generating an average in dependence upon said plurality of said section parameters; and saving said mapping on a computer readable medium for use in a speech assessment method according to claim 1.

* * * * *

UNITED STATES PATENT AND TRADEMARK OFFICE

CERTIFICATE OF CORRECTION

PATENT NO. : 7,406,419 B2
APPLICATION NO. : 10/862840
DATED : July 29, 2008
INVENTOR(S) : Ludovic Malfait It is certified that error appears in the above-identified patent and that said Letters Patent is hereby corrected as shown below:

Column 8

*Line 19:* please add --selecting-- before "a plurality"
*Line 26:* please add --average-- before "value"
*Line 30:* please add --of-- after "plurality"

Signed and Sealed this

Nineteenth Day of May, 2009

JOHN DOLL
*Acting Director of the United States Patent and Trademark Office*